US010973091B2

(12) United States Patent
Son et al.

(10) Patent No.: US 10,973,091 B2
(45) Date of Patent: Apr. 6, 2021

(54) INDUCTION HEAT COOKING APPARATUS AND OPERATING METHOD THEREOF

(71) Applicant: LG Electronics Inc., Seoul (KR)

(72) Inventors: Seongho Son, Seoul (KR); Taewoong Kong, Seoul (KR); Younghwan Kwack, Seoul (KR); Jaekyung Yang, Seoul (KR); Yongsoo Lee, Seoul (KR); Hyojin Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 286 days.

(21) Appl. No.: 16/054,372

(22) Filed: Aug. 3, 2018

(65) Prior Publication Data

US 2019/0045586 A1 Feb. 7, 2019

(30) Foreign Application Priority Data

Aug. 4, 2017 (KR) ..... 10-2017-0098877

(51) Int. Cl.
*H05B 6/06* (2006.01)
*H05B 6/08* (2006.01)
(Continued)

(52) U.S. Cl.
CPC ..... *H05B 6/062* (2013.01); *F24C 7/067* (2013.01); *F24C 7/083* (2013.01); *F24C 7/087* (2013.01);
(Continued)

(58) Field of Classification Search
CPC .. H05B 6/1236; H05B 6/062; H05B 2213/05; F24C 7/087; F24C 7/067
USPC ..... 219/626, 663, 665, 664, 627, 667, 625, 219/449.1, 459.1, 463.1, 518; 363/97, 49, 363/78, 160; 323/901
See application file for complete search history.

(56) References Cited

U.S. PATENT DOCUMENTS 5,424,514 A 6/1995 Lee
5,700,996 A 12/1997 Lee et al.
(Continued)

FOREIGN PATENT DOCUMENTS

DE 4428353 2/1995
DE 112013007526 7/2016
(Continued)

OTHER PUBLICATIONS

EP Search Report in European Appln No. 18187255, dated Dec. 19, 2018, 8 pages.
(Continued)

*Primary Examiner* — Quang T Van
(74) *Attorney, Agent, or Firm* — Fish & Richardson P.C.

(57) ABSTRACT

Disclosed herein is an induction heat cooking apparatus including a power supply configured to supply an alternating current (AC) voltage, a rectifier configured to rectify the supplied AC voltage into a direct current (DC) voltage, first and second switching units configured to control switching such that the DC voltage from the rectifier is alternately applied to a working coil, a comparison unit configured to sense current flowing in the working coil and to compare the sensed current with a predetermined reference value to output pulses, and a controller configured to determine whether a cooking vessel is present on the working coil based on the output pulses.

13 Claims, 5 Drawing Sheets

(51) Int. Cl.

| | |
|---|---|
| ***H05B 6/04*** | (2006.01) |
| ***F24C 7/06*** | (2006.01) |
| ***F24C 7/08*** | (2006.01) |
| ***H05B 6/12*** | (2006.01) |

(52) U.S. Cl.
CPC ..... *H05B 6/1236* (2013.01); *H05B 2213/05* (2013.01)

(56) References Cited

U.S. PATENT DOCUMENTS

| | | | | |
|---|---|---|---|---|
| 2013/0284723 | A1* | 10/2013 | Weder ..... | H05B 6/1245 219/624 |
| 2018/0063891 | A1* | 3/2018 | Imai ..... | H02M 7/53803 |
| 2020/0029397 | A1 | 1/2020 | Kwack et al. | |
| 2020/0029398 | A1 | 1/2020 | Kwack et al. | |

FOREIGN PATENT DOCUMENTS

| | | |
|---|---|---|
| EP | 2360989 | 8/2011 |
| EP | 3598849 | 1/2020 |
| EP | 3598850 | 1/2020 |
| JP | 2016042431 | 3/2016 |
| KR | 100204886 | 6/1999 |
| KR | 1020040063540 | 7/2004 |
| KR | 20160146376 | 12/2016 |

OTHER PUBLICATIONS

European Search Report in European Appln. No. 18187255.7, dated Jun. 15, 2020, 7 pages.

* cited by examiner

INDUCTION HEAT COOKING APPARATUS AND OPERATING METHOD THEREOF

CROSS-REFERENCE TO RELATED APPLICATIONS

The present application claims the benefits of priority to Korean Patent Application No. 10-2017-0098877, filed on Aug. 4, 2017, which are herein incorporated by reference in their entirety.

FIELD

The present invention relates to an induction heat cooking apparatus and a method of operating the same and, more particularly, to an induction heat cooking apparatus for sensing whether a cooking vessel is located on the induction heat cooking apparatus, and a method of operating the same.

BACKGROUND

Recently, electric ranges have come into widespread use, because the electric ranges do not generate carbon monoxide in a combustion process and have a low risk of safety accidents such as gas leak or fire.

Meanwhile, an electric range may use a highlight method of converting electricity into heat using a nichrome wire having high electrical resistance or an induction method of generating a magnetic field to apply heat using an electromagnetic induction method.

An induction heat cooking apparatus may mean an electric range operating according to the induction method. A detailed principle of the induction heat cooking apparatus will now be described.

In general, the induction heat cooking apparatus enables high-frequency current to flow in a working coil or a heating coil provided therein. When high-frequency current flows in the working coil or the heating coil, strong lines of magnetic force are generated. The lines of magnetic force generated in the working coil or the heating coil generate eddy current upon passing through a cooking vessel. Accordingly, heat is generated in the cooking vessel according to flow of Eddy current to heat the cooking vessel. As the cooking vessel is heated, food contained in the vessel is heated.

The induction heat cooking apparatus is an electric cooking apparatus for inducing heat in a cooking vessel to heat food. When the induction heat cooking apparatus is used, oxygen is not consumed and waste gas is not generated, thereby decreasing indoor air pollution. In addition, the induction heat cooking apparatus has high energy efficiency and safety. In addition, the induction heat cooking apparatus heats a vessel, thereby reducing risk of burns.

Meanwhile, if the induction heat cooking apparatus includes several burners, it may difficult for a user to intuitively distinguish between buttons for respectively adjusting the burners. Alternatively, even when a cooking vessel is not located on the induction heat cooking apparatus, energy for heating may be consumed. In order to solve such problems, there is a need for a method of, at an induction heat cooking apparatus, automatically determining whether a cooking vessel is present.

SUMMARY

An object of the present invention is to provide an induction heat cooking apparatus for automatically determining whether a cooking vessel is located on the induction heat cooking apparatus, and a method of operating the same.

According to an aspect of the present invention, an induction heat cooking apparatus includes a power supply configured to supply an alternating current (AC) voltage, a rectifier configured to rectify the supplied AC voltage into a direct current (DC) voltage, first and second switching units configured to control switching such that the DC voltage from the rectifier is alternately applied to a working coil, a comparison unit configured to sense current flowing in the working coil and to compare the sensed current with a predetermined reference value to output pulses and a controller configured to determine whether a cooking vessel is present on the working coil based on the output pulses.

The comparison unit may output pulses having a high level when the sensed current is greater than the reference value and having a low level when the sensed current is less than the reference value.

The controller may determine whether the cooking vessel is present based on an on-time width which corresponds to a time when any one of the output pulses is maintained at a high level.

The controller may determine whether the cooking vessel is present based on the on-time width of a firstly output pulse among the output pulses.

The controller may determine that the cooking vessel is present on the working coil when the on-time width of the pulse is equal to or less than a predetermined reference width and determine that the cooking vessel is not present on the working coil when the on-time width of the pulse exceeds the predetermined reference width.

The controller may count the output pulses and determine whether the cooking vessel is present based on the number of counted pulses.

The controller may count the output pulses while any one of the first and second switching units is maintained in an ON state and determine whether the cooking vessel is present.

The controller may determine that the cooking vessel is present on the working coil when the number of output pulses is equal to or less than a predetermined reference number and determine that the cooking vessel is not present on the working coil when the number of output pulses exceeds the predetermined reference number.

The controller may output a blocking signal such that current does not flow in the working coil, upon determining that the cooking vessel is not present on the working coil.

The controller may determine whether the cooking vessel is present on the working coil based on a pulse output after the first and second switching units alternately apply the DC voltage to the working coil a predetermined number of times or more.

The reference value may be an average of current flowing in the working coil, which is output in the form of a voltage, as the DC voltage is applied to the working coil a plurality of times by the first and second switching units.

DETAILED DESCRIPTION

Hereinafter, embodiments disclosed in this specification will be described in detail with reference to the accompanying drawings.

Figure 1:
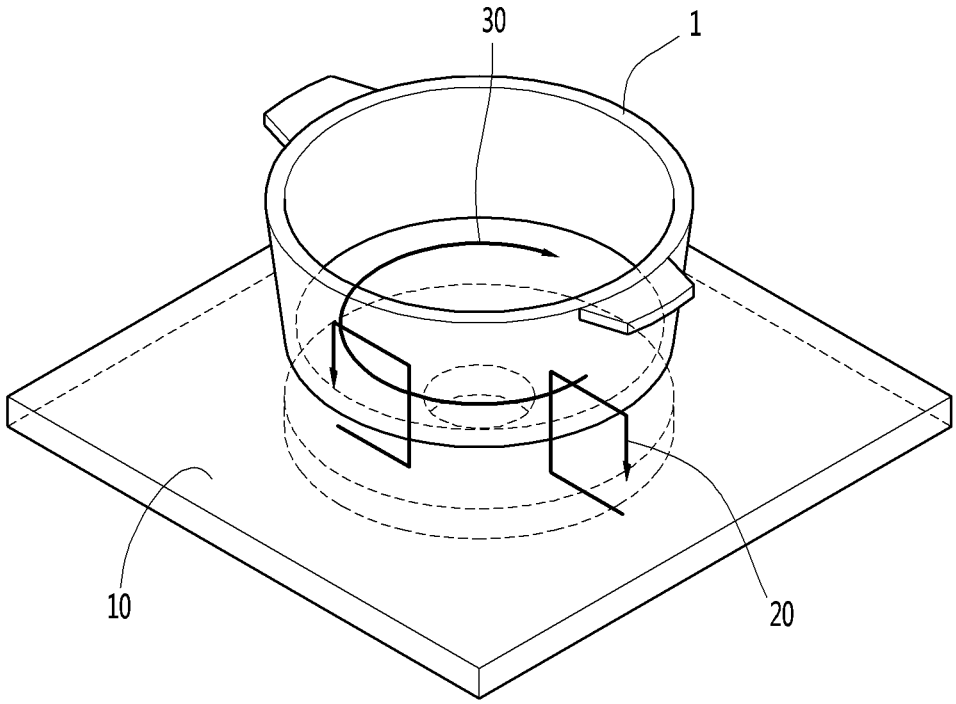
FIG. 1 is a diagram illustrating operation of an induction heat cooking apparatus.

FIG. 1 is a diagram illustrating operation of an induction heat cooking apparatus.

Referring to FIG. 1, a cooking vessel 1 may be located on the induction heat cooking apparatus 10. The induction heat cooking apparatus 10 may heat the cooking vessel 1 provided thereon.

Specifically, a method of heating the cooking vessel 1 using the induction heat cooking apparatus 10 will be described. The induction heat cooking apparatus 10 may enable current to flow in a working coil, thereby generating a magnetic field 20. At least some of the magnetic field 20 generated by the induction heat cooking apparatus 10 may pass through the cooking vessel 1.

At this time, if an electric resistance component is included in a material of the cooking vessel 1, the magnetic field 20 may generate Eddy current 30 in the cooking vessel 1. Eddy current 30 heats the cooking vessel 1. The heat is delivered to the inside of the cooking vessel 1. Therefore, food contained in the cooking vessel 1 may be cooked and the induction heat cooking apparatus 10 may operate using such a method.

Meanwhile, if an electric resistance component is not included in the material of the cooking vessel 1, Eddy current 30 may not be generated. Accordingly, in this case, it may be difficult for the induction heat cooking apparatus 10 to heat the cooking vessel 1. Accordingly, the cooking vessel 1 may be made of a metal material such as stainless steel, enamel or cast iron in order to be heated by the induction heat cooking apparatus 10.

Figure 2:
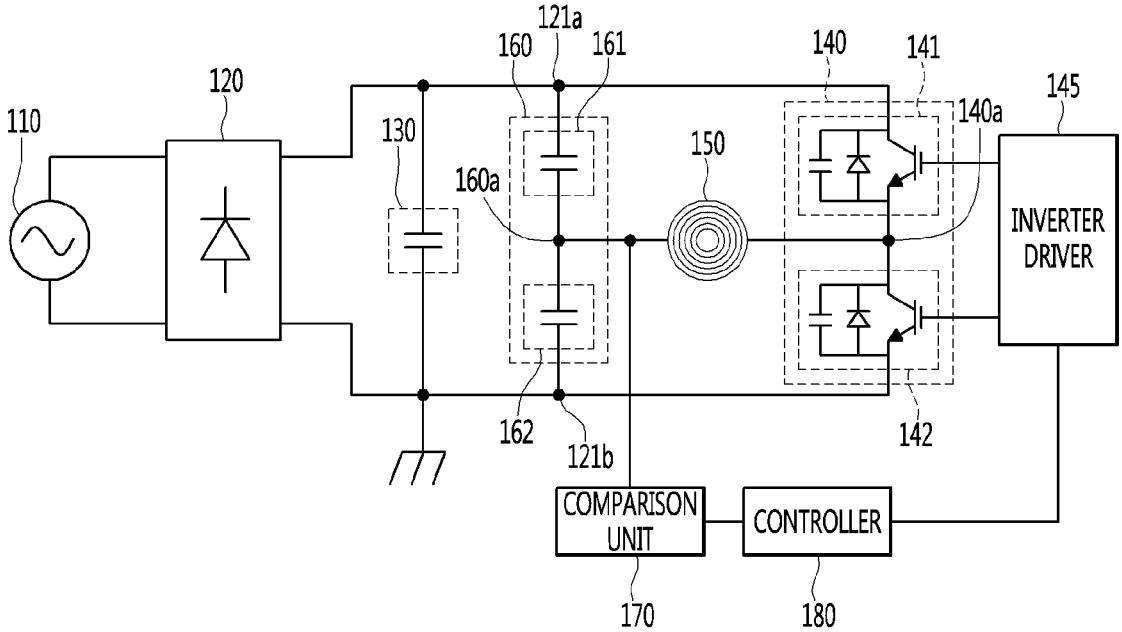
FIG. 2 is a circuit diagram of an induction heat cooking apparatus according to an embodiment of the present invention.

Next, FIG. 2 is a circuit diagram of an induction heat cooking apparatus according to an embodiment of the present invention.

Referring to FIG. 2, the induction heat cooking apparatus includes a power supply 110, a rectifier 120, a DC link capacitor 130, an inverter 140, a working coil 150, a resonance capacitor 160, a comparison unit 170 and a controller 180.

The power supply 110 may supply an AC voltage to the induction heat cooking apparatus. More specifically, the power supply 110 may supply an AC voltage to the rectifier 120 of the induction heat cooking apparatus.

The rectifier 120 is an electric device for converting an AC voltage into a DC voltage. The rectifier 120 may convert the AC voltage received from the power supply 110 into the DC voltage.

The DC link capacitor 130 serves as a buffer between the power supply 110 and the inverter 140. Specifically, the DC link capacitor 130 may maintain and supply the DC voltage converted by the rectifier 120 to the inverter 140.

The inverter 140 may switch a voltage applied to the working coil 150 such that high-frequency current flows in the working coil 150. Specifically, the inverter 140 may include a first switching unit 141 and a second switching unit 1420, and the first switching unit 141 and the second switching unit 142 may be alternately and repeatedly turned on/off to drive the working coil 150. That is, the first switching unit 141 may be turned on and the second switching unit 142 may be turned off in a first state, the first switching unit 141 may be turned off and the second switching unit 142 may be turned on in a second state, and the inverter 140 may be controlled to alternate between the first state and the second state at a predetermined frequency. When the first switching unit 141 and the second switching unit 142 are controlled to be alternately turned on, the DC voltage from the rectifier 120 may be alternately applied to the working coil 150. The working coil 150 may be driven by alternately applying the DC voltage.

Each of the first switching unit 141 and the second switching unit 142 may be a switching element made of an insulated gate bipolar transistor (IGBT). As the first switching unit 141 and the second switching unit 142 are alternately turned on, high-frequency current flows in the working coil 150 and thus a high-frequency magnetic field may be formed in the working coil 150.

The DC voltage may be alternately applied to the working coil 150 by the inverter 140. As the DC voltage may be alternately applied to the working coil 150, current may flow in the working coil. The working coil 150 may generate a magnetic field by current to heat the cooking vessel.

One end of the working coil 150 may be connected to a node 140*a* between the first and second switching units 141 and 142 and the other end thereof may be connected to a node 161 between first and second resonance capacitors 161 and 162.

The inverter 140 may be driven by an inverter driver 145.

The inverter driver 145 may control switching of the first and second switching units 141 and 142 configuring the inverter 140. The inverter driver 145 may control the first and second switching units 141 and 142 to alternately operate. That is, the inverter driver 145 may repeat operation for performing control to turn the first switching unit on and to turn the second switching unit 142 off, performing control to turn the first switching unit off and to turn the second switching unit 142 on after a predetermined time, and performing control to turn the first switching unit on and to turn the second switching unit 142 off after a predetermined time. The inverter driver 145 may control the first and second switching units 141 and 142 to apply the high-frequency voltage to the working coil 150.

The resonance capacitor 160 may serve as a buffer. The resonance capacitor 160 may adjust a saturation voltage increasing rate while the first and second switching units 141 and 142 are turned off. Therefore, the resonance capacitor 160 can minimize energy loss during an OFF time.

The resonance capacitor 160 may include a plurality of resonance capacitors 161 and 162 connected between the DC link capacitor 130 and the working coil 150 in series.

The resonance capacitor 160 may include a first resonance capacitor 161 and a second resonance capacitor 162. Specifically, one end of the first resonance capacitor 161 may be connected to one end 121*a* of the rectifier 120 for outputting the voltage and the other end thereof may be connected to a connection point 160*a* between the second resonance capacitor 162 and the working coil 150. Similarly, one end of the second resonance capacitor 162 may be connected to the other end 121*b* of the rectifier 120 for outputting the voltage and the other end thereof may be connected to a connection point 160*a* between the first resonance capacitor 161 and the working coil 150.

Capacitance of the first resonance capacitor 161 may be equal to that of the second resonance capacitor 162.

Meanwhile, the resonance frequency of the induction heat cooking apparatus may be determined by capacitance of the resonance capacitor 160.

Specifically, the resonance frequency of the induction heat cooking apparatus shown in FIG. 2 is determined by inductance of the working coil 150 and capacitance of the resonance capacitor 160.

In addition, a resonance curve may be formed centered on the resonance frequency determined by the inductance of the working coil 150 and the capacitance of the resonance capacitor 160. The resonance curve may indicate output power according to frequency.

The comparison unit 170 may compare current flowing in the working coil 150 with a predetermined reference value. Specifically, the comparison unit 170 may sense current flowing in the working coil 150 and output the sensed current in the form of a voltage. The comparison unit 170 may compare the output voltage with the predetermined reference value to output pulses.

Here, the reference value may include a reference voltage. The reference voltage may be set upon installing the induction heat cooking apparatus. The reference voltage may be calculated using the following method. First, the DC voltage may be applied to the working coil 150 plural times or more. As the first and second switching units 141 and 142 are alternately turned on/off, the DC voltage may be applied to the working coil 150. When the DC voltage is applied to the working coil 150, current may flow in the working coil 150 and the controller 180 may sense current flowing in the working coil 150 whenever the DC voltage is applied plural times, and output the sensed current in the form of a voltage. The controller 180 may determine an average of a plurality of output voltages as a reference voltage. Alternatively, the controller 180 may determine a value greater or less than the average of the plurality of output voltages by a predetermined voltage as a reference voltage, and the predetermined voltage may be changed according to the type of the cooking vessel to be identified. The reference value may be about an average of the values output when the DC voltage is applied to the working coil 150 plural times or more.

The comparison unit 170 may first sense current flowing in the working coil 150. The comparison unit 170 may be connected between a node 140*a* between the first and second switching units 141 and 142 and the working coil 150 to sense current flowing in the working coil 150 or may be connected between a node 160*a* between the first and second resonance capacitors 161 and 162 and the working coil 150 to sense current flowing in the working coil 150. The comparison unit 170 may output current flowing in the working coil 150 in the form of a voltage.

Meanwhile, the reference voltage may be pre-set in the comparison unit 170. The comparison unit 170 may compare a voltage output upon sensing current flowing in the working coil 150 with the reference voltage. The method of comparing the voltage output upon sensing current flowing in the working coil 150 with the reference voltage will be described with reference to FIG. 3.

Figure 3:
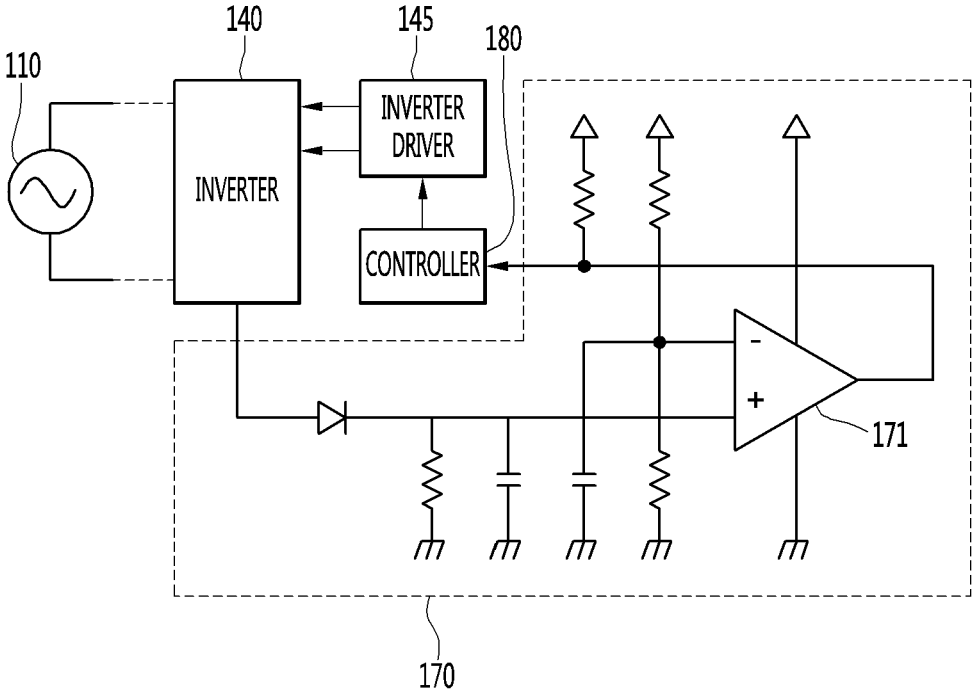
FIG. 3 is a circuit diagram showing a comparison unit of an induction heat cooking apparatus according to an embodiment of the present invention in detail.

FIG. 3 is a circuit diagram showing a comparison unit of an induction heat cooking apparatus according to an embodiment of the present invention in detail.

As shown in FIG. 3, the comparison unit 170 may include a diode, at least one resistor, at least one capacitor and a comparator 171. The comparator 171 may include a non-inverting terminal (+) and an inverting terminal (−). Current flowing in the working coil 150 may be input to the non-inverting terminal (+) of the comparator 171. That is, current flowing in the working coil 150, which is output in the form of a voltage, may be input to the non-inverting terminal (+) of the comparator 171. The predetermined reference voltage may be input to the inverting terminal (−) of the comparator 171. The comparator 171 may compare current flowing in the working coil 150, which is input to the non-inverting terminal (+), with the reference voltage input to the inverting terminal (−) to output pulses. The pulses output from the comparator 171 may be delivered to the controller 180.

The controller 180 may determine whether the cooking vessel is present on the induction heat cooking apparatus based on the output pulses received from the comparison unit 170. More specifically, the controller 180 may determine whether the cooking vessel is present on the working coil 150 based on the pulses output from the comparison unit 170. A method of, at the controller 180, determining whether the cooking vessel is present on the working coil 150 will be described in detail below.

Meanwhile, the controller 180 may control overall operation of the induction heat cooking apparatus. The controller 180 may control at least one of the power supply 110, the rectifier 120, the DC link capacitor 130, the inverter 140, the inverter driver 145, the working coil 150, the resonance capacitor 160 and the comparison unit 170.

For example, the controller 180 may control switching timings when the inverter driver 145 drives the first switching unit 141 and the second switching unit 142. However, this is merely exemplary and the controller 180 may control determination as to whether the cooking vessel is present or operation of the induction heat cooking apparatus depending on whether the cooking vessel is present.

Figure 4:
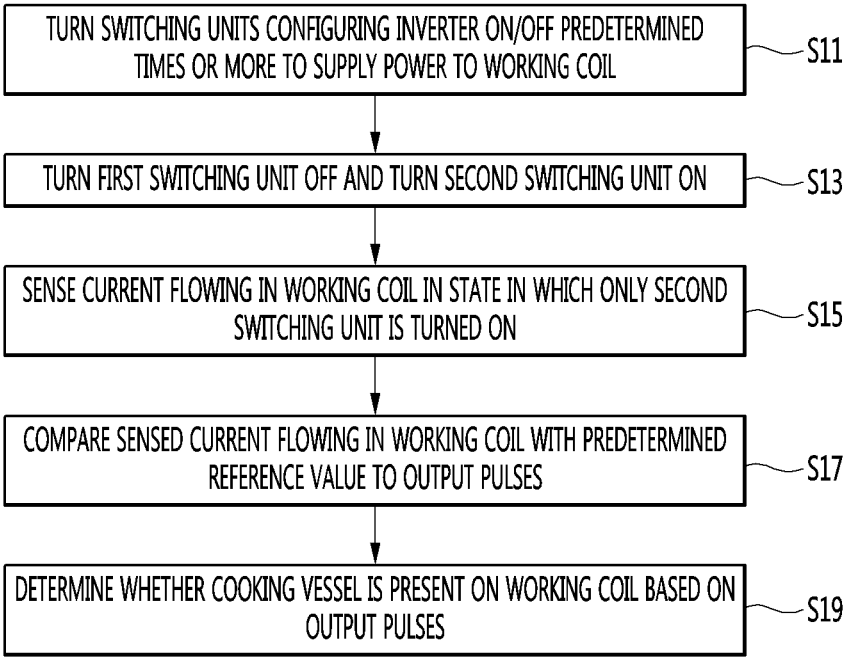
FIG. 4 is a flowchart illustrating a method of, at an induction heat cooking apparatus, determining whether a cooking vessel is present according to an embodiment of the present invention.

Next, the method of, at the induction heat cooking apparatus, determining whether the cooking vessel is present according to the embodiment of the present invention will be described. FIG. 4 is a flowchart illustrating a method of, at an induction heat cooking apparatus, determining whether a cooking vessel is present according to an embodiment of the present invention.

The controller 180 may turn the switching units configuring the inverter 140 on/off predetermined times or more to supply power to the working coil 150 (S11).

The induction heat cooking apparatus according to the present invention may determine whether the cooking vessel is present using the pulses output by comparing current flowing in the working coil 150 with the predetermined reference value. At this time, when power is not sufficiently supplied to the working coil 150, the pulses may not be stably output, thereby lowering reliability.

Accordingly, the controller 180 may perform control such that the first and second switching units 141 and 142 configuring the inverter 140 are alternately and repeatedly turned on/off predetermined times or more in order to sufficiently supply power to the working coil 150. For example, the controller 180 may perform control such that the first switching unit 141 is repeatedly turned on/off 11 times at a predetermined period and the second switching unit 142 is repeatedly turned off/on 11 times at a predetermined period. However, the repetition number of switching is merely exemplary and may be changed according to the type of the working coil 150, inductance of the working coil 150, etc.

The first and second switching units 141 and 142 may be repeatedly turned on/off minimum times for stabilizing a pulse transformer. Therefore, when the pulse transformer is stabilized by repeatedly turning the first and second switching units 141 and 142 on/off predetermined times or more, whether a cooking vessel is present may be determined using previously supplied power. Therefore, whether a cooking vessel is present may be sensed with very low power consumption.

The controller 180 may turn the first switching unit 141 off and turn the second switching unit 142 on (S13).

In contrast, the controller 180 may turn the first switching unit 141 on and turn the second switching unit 142 off. That is, the controller 180 may turn one of the first and second switching units 141 and 142 on and turn the other of the first and second switching units off, regardless of the position of the switching unit. Hereinafter, for convenience of description, assume that the controller 180 turns the first switching unit 141 off and turns the second switching unit 142 on.

The controller 180 may sense current flowing in the working coil 150 in a state in which only the second switching unit 142 is turned on (S15).

The controller 180 may control the comparison unit 170 to sense current flowing in the working coil 150 in a state in which the first switching unit 141 is turned off and the second switching unit 142 is turned on. The comparison unit 170 may sense current flowing in the working coil 150 in a state in which only the second switching unit 142 is turned on.

The controller 180 may compare current flowing in the working coil 150 with the predetermined reference value to output pulses (S17).

The controller 180 may input current flowing in the working coil 150, which is output in the form of a voltage, to the non-inverting terminal (+) of the comparator 171 and input the predetermined reference value to the inverting terminal (−) of the comparator 171. Here, the reference value may be a reference voltage. The controller 180 may output pulses indicating a difference between current flowing in the working coil 150 and the reference voltage.

The controller 180 may determine whether a cooking vessel is present on the working coil 150 based on the output pulses (S19).

The controller 180 may analyze the pulses output from the comparison unit 170 and determine whether a cooking vessel is present on the working coil 150. Since the level of current flowing in the working coil 150 when the cooking vessel is located on the working coil 150 is different from the level of current flowing in the working coil 150 when the cooking vessel is not located on the working coil 150, the pulses output from the comparison unit 170 are changed depending on whether the cooking vessel is present.

Next, the pulses output from the comparison unit 170 and the method of determining whether a cooking vessel is present according to the output pulses will be described with reference to FIG. 5.

Figure 5:
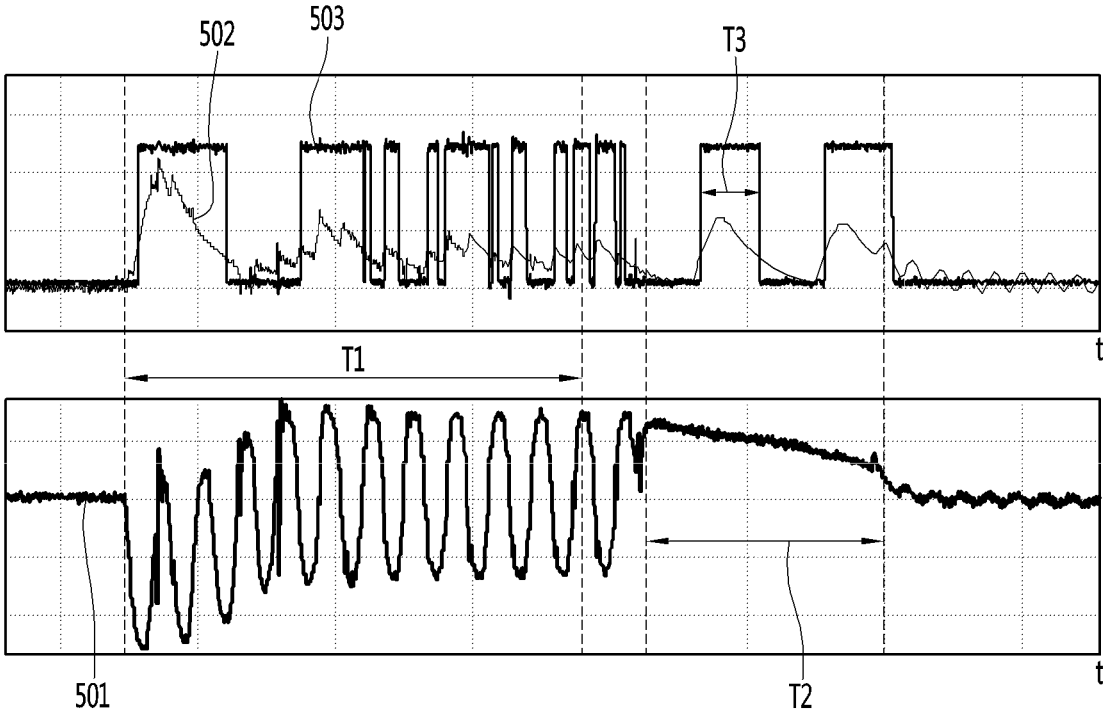
FIG. 5 is a diagram illustrating pulses output from a comparison unit according to an embodiment of the present invention.

FIG. 5 is a diagram illustrating pulses output from a comparison unit according to an embodiment of the present invention.

Referring to FIG. 5, a first waveform 501 may indicate a gate voltage of the second switching unit 142, a second waveform 502 may indicate current flowing in the working coil 150, and a third waveform 503 may indicate a pulse output from the comparison unit 170.

First, referring to the first waveform 501, the waveform indicating the gate voltage of the second switching unit 142 may include a first period T1 in which the voltage is repeatedly increased and decreased by a predetermined level. The first period T1 may include the gate voltage measured while the second switching unit 142 is repeatedly turned on/off, and the repetition number of increase/decrease in the voltage may be equal to the repetition number of ON/OFF of the second switching unit 142. As the second switching unit 142 is turned on/off predetermined times or more, sufficient power can be received.

The second switching unit 142 may be turned on for a predetermined time after being turned on/off predetermined times or more. A second period T2 may indicate a period in which the second switching unit 142 is maintained in an ON state after receiving sufficient power. If sufficient power is not supplied to the second switching unit 142, a time when the second switching unit 142 is maintained in the ON state may be reduced. That is, the length of the second period T2 may be reduced. When the length of the second period T1 is reduced, it may be difficult to obtain the pulses output from the comparison unit 170, which may be used to determine whether a vessel is present.

Meanwhile, the second waveform 502 may indicate current flowing in the working coil 150, which is output in the form of a voltage. The third waveform 503 may indicate the pulse output from the comparison unit 170, which may have a high level when current flowing in the working coil 150 is greater than the predetermined reference value and may have a low level when current flowing in the working coil 150 is less than the predetermined reference value.

The controller 180 may analyze the third waveform 503 while the second switching unit 142 is turned on to determine whether a cooking vessel is present.

According to a first embodiment of the present invention, the controller 180 may measure an on-time width T3 of the third waveform 503 while the second switching unit 142 is turned on to determine whether a cooking vessel is present.

According to a second embodiment of the present invention, the controller 180 may count the repetition number of the pulse of the third waveform 503 while the second switching unit 142 is turned on to determine whether a cooking vessel is present.

Figure 6:
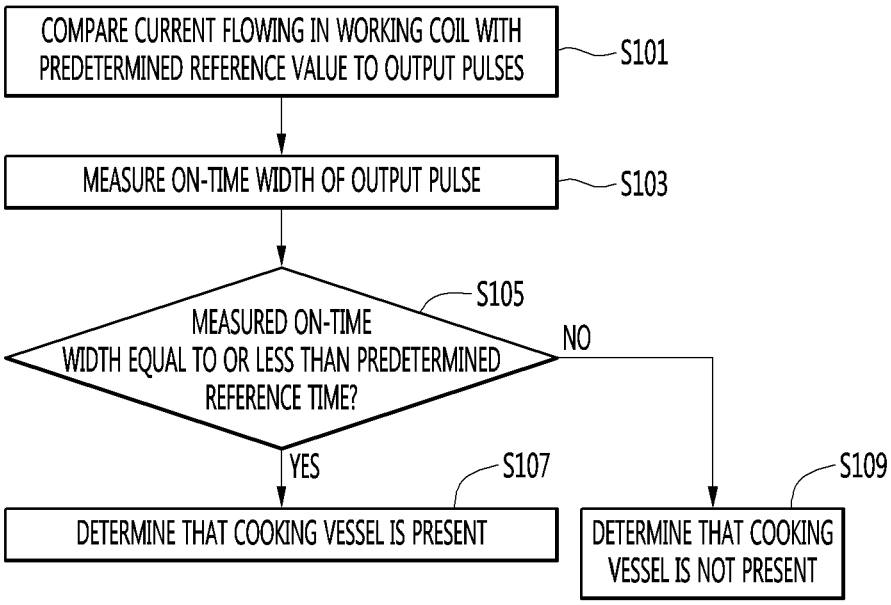
FIG. 6 is a flowchart illustrating a method of determining whether a cooking vessel is present according to a first embodiment of the present invention.
Figure 7:
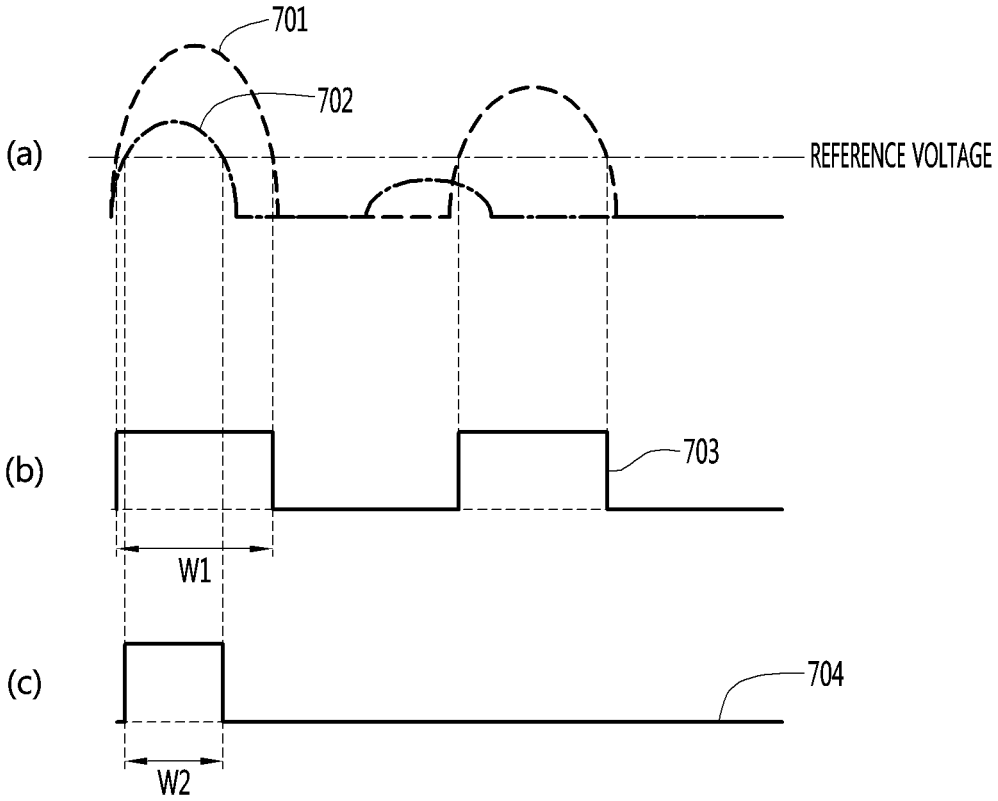
FIG. 7 is a diagram showing pulses output from a comparison unit in order to illustrate the method of determining whether the cooking vessel is present according to the first embodiment of the present invention.

First, a method of determining whether a cooking vessel is present according to a first embodiment of the present invention will be described with reference to FIGS. 6 and 7. FIG. 6 is a flowchart illustrating a method of determining whether a cooking vessel is present according to a first embodiment of the present invention. FIG. 7 is a diagram showing pulses output from a comparison unit in order to illustrate the method of determining whether the cooking vessel is present according to the first embodiment of the present invention.

FIG. 6 is a flowchart illustrating a method of, at the controller 180, determining whether a cooking vessel is present on the working coil 150 based on the pulse output from the comparison unit 170 in step S19 of determining whether the cooking vessel is present as shown in FIG. 4, according to the first embodiment of the present invention.

The controller 180 may compare current flowing in the working coil 150 with the predetermined reference value to output pulses (S101).

The controller 180 may measure the on-time width of the output pulses (S103).

Here, the on-time may indicate a time when the pulse output from the comparison unit 170 has a high level in a state in which the first switching unit 141 is turned off and the second switching unit 142 is turned on. Accordingly, the on-time width may mean a time when current flowing in the working coil 150 is continuously greater than the predetermined reference value in a state in which the first switching unit 141 is turned off and the second switching unit 142 is turned on.

The on-time width will be described with reference to FIG. 7. FIG. 7(*a*) may show first and second currents 701 and 702 flowing in the working coil 150. The first pulse 703 of FIG. 7(*b*) is a pulse output when the first current 701 passes through the comparison unit 170, has a high level when the first current 701 is greater than a reference value, and has a low level when the first current 701 is less than the reference value. Similarly, the second pulse 704 of FIG. 7(*b*) is a pulse output when the second current 702 passes through the comparison unit 170, has a high level when the second current 702 is greater than a reference value and has a low level when the second current 702 is less than the reference value.

At this time, the on-time width w1 of FIG. 7(*b*) may indicate the on-time width of the first current 701 and the on-time width w2 of FIG. 7(*c*) may indicate the on-time width of the second current 702.

If a load is not present on the working coil 150, the on-time width may be largest. This is because the peak of current flowing in the working coil 150 is highest when a load is not present on the working coil 150.

Meanwhile, when a load is present on the working coil 150, a frequency is low and thus a peak is decreased. Accordingly, when the load is present on the working coil 150, the on-time width may be decreased. As the size of the load present on the working coil 150 is increased, the on-time width may be decreased.

FIG. 6 will be described again.

The controller 180 may determine whether the measured on-time width is equal to or less than a predetermined reference time (S105).

The controller 180 may compare an on-time width measured earliest among measured on-time widths with the predetermined reference time. That is, the controller 180 may compare a firstly output pulse among pulses output from the comparison unit 170 with the predetermined reference time to determine whether a cooking vessel is present.

The controller 180 may pre-set the reference time. The controller 180 may set the reference time according to the properties of at least one cooking vessel, the presence/absence of which will be determined.

The controller 180 may determine that the cooking vessel is present (S107), when the measured on-time width is equal to or less than the predetermined reference time.

In this case, the controller 180 may perform control such that the induction heat cooking apparatus normally operates. That is, the cooking vessel may be heated under control of the user.

The controller 180 may determine that the cooking vessel is not present (S109), when the measured on-time width exceeds the predetermined reference time.

In this case, the controller 180 may output a blocking signal. That is, the controller 180 may block current such that current does not flow in the working coil 150, in order to prevent heating operation regardless of control of the user.

For example, the controller 180 may set the reference time to 17 μs. The controller 180 may determine that the cooking vessel is present on the working coil 150 when the on-time width is equal to or less than 17 μs and may determine that the cooking vessel is not present on the working coil 150 when the on-time width exceeds 17 μs.

Therefore, in addition to the case where the cooking vessel is not present on the working coil 150, even when a element (e.g., aluminum, etc.) which should not be heated by the working coil 150 is present, it may be determined that the cooking vessel is not present, thereby preventing malfunction of the induction heat cooking apparatus.

In addition, according to the first embodiment of the present invention, the induction heat cooking apparatus including the switching unit driven using a pulse transformer insulation method can more accurately determine whether the cooking vessel is present. Specifically, the on-state maintenance time of the switching unit driven using the pulse transformer insulation method is relatively short. However, since the on-state maintenance time of the switching unit is shorter than the on-time width, if the on-time width is used as in the first embodiment of the present invention, it is possible to more accurately determine whether a cooking vessel is present.

In addition, according to another embodiment of the present invention, the controller 180 may set the on-time width according to the material of the cooking vessel. In this case, the controller 180 may determine the material of the cooking vessel according to the measured on-time width. The controller 180 may determine the material of the cooking vessel and recommend a cooking time, a cooking method and the intensity of a burner suitable for the material of the cooking vessel.

Figure 8:
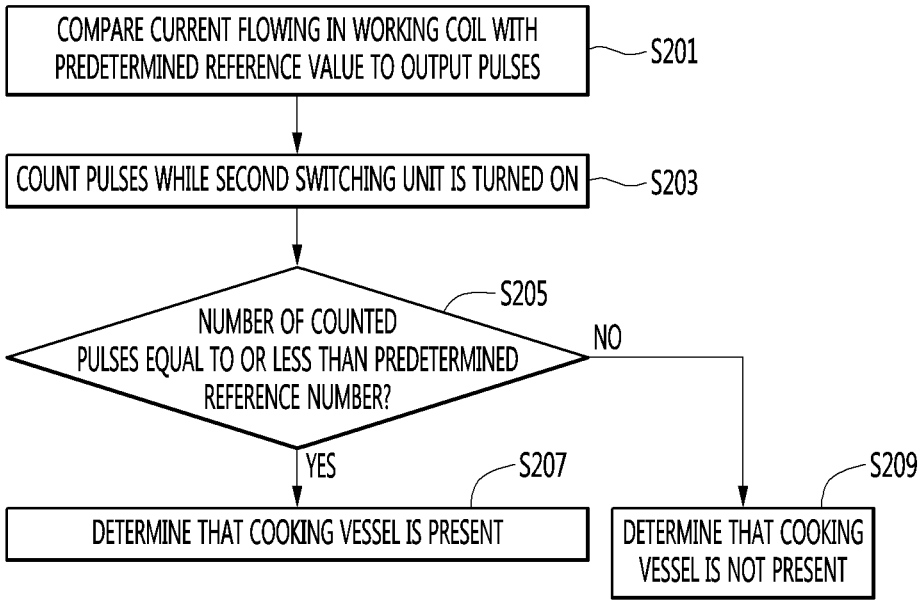
FIG. 8 is a flowchart illustrating a method of determining whether a cooking vessel is present according to a second embodiment of the present invention.
Figure 9:
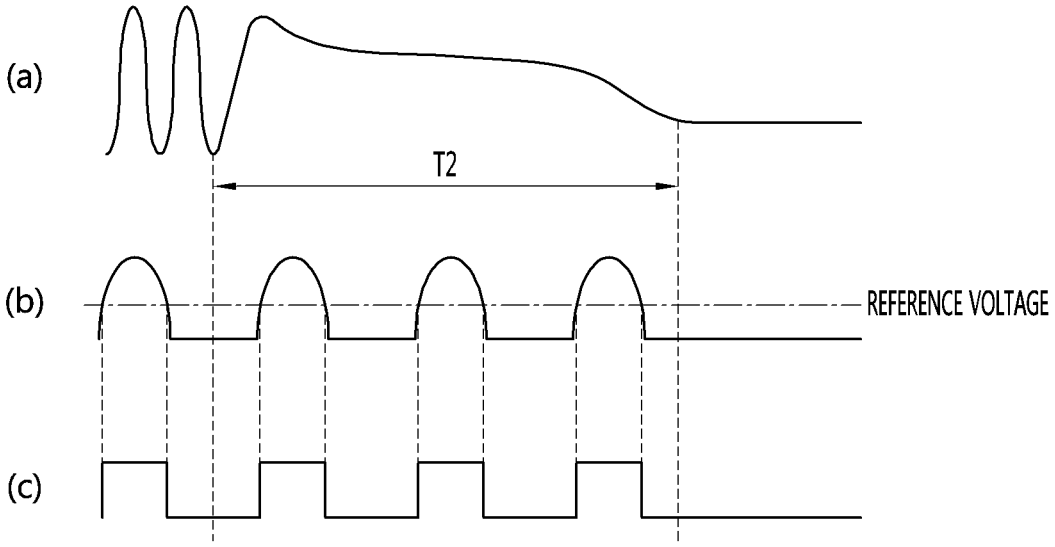
FIG. 9 is a diagram showing pulses output from a comparison unit in order to illustrate the method of determining whether the cooking vessel is present according to the second embodiment of the present invention.

Next, a method of determining whether a cooking vessel is present according to a second embodiment of the present invention will be described with reference to FIGS. 8 to 9. FIG. 8 is a flowchart illustrating a method of determining whether a cooking vessel is present according to a second embodiment of the present invention. FIG. 9 is a diagram showing pulses output from a comparison unit in order to illustrate the method of determining whether the cooking vessel is present according to the second embodiment of the present invention.

FIG. 8 is a flowchart illustrating a method of determining whether a cooking vessel is present on the working coil 150 based on the pulses output from the comparison unit 170 at the controller 180 in step S19 of determining whether the cooking vessel is present as shown in FIG. 4, according to the second embodiment of the present invention.

The controller 180 may compare current flowing in the working coil 150 with the predetermined reference value to output pulses (S201).

The controller 180 may count pulses while the second switching unit 142 is turned on (s203).

The method of counting the pulses will now be described. FIG. 9(*a*) shows the gate voltage of the second switching unit 142 and a second period T2 of FIG. 9(*a*) means an on-state maintenance time of the second switching unit 142.

FIG. 9(*b*) shows current flowing in the working coil 150. FIG. 9(*c*) shows a pulse which has a high level when current flowing in the working coil 150 is greater than the predetermined reference value and has a low level when current flowing in the working coil 150 is less than the predetermined reference value, as a result of comparing current flowing in the working coil 150 with the predetermined reference value.

The controller 180 may count the pulses output during the on-state maintenance time of the second switching unit 142. Here, in counting of the output pulses, a state in which a low level is changed to a high level and then is changed to a low level again is counted as one pulse. According to the example shown in FIG. 9(*c*), the controller 180 may count three pulses.

FIG. 8 will be described again.

The controller 180 may determine whether the number of counted pulses is equal to or less than a predetermined reference number (S205).

The controller 180 may determine that the cooking vessel is present (S207), if the number of counted pulses is equal to or less than the predetermined reference number.

In this case, the controller 180 may perform control such that the induction heat cooking apparatus normally operates. That is, the cooking vessel may be heated under control of the user.

In contrast, the controller 180 may determine that the cooking vessel is not present (S209), if the number of counted pulses exceeds the predetermined reference number.

In this case, the controller 180 may output a blocking signal. That is, the controller 180 may block current such that current does not flow in the working coil 150, in order to prevent heating operation regardless of control of the user.

According to various embodiments of the present invention, since power for sensing the cooking vessel may not be continuously supplied, the cooking vessel can be sensed with low power.

In addition, when the cooking vessel is not sensed, the blocking signal is output, thereby preventing heating in a no-load state and preventing the switching unit from being damaged.

In addition, a switch corresponding to a burner on which a sensed cooking vessel is located is activated, such that the user can easily identify the burner and the switch corresponding thereto. Thus, it is possible to increase user convenience.

According to the embodiments of the present invention, by determining whether a cooking vessel is present using previously supplied power, power required to determine whether a cooking vessel is present may be reduced.

According to the embodiments of the present invention, when a cooking vessel is not present or when there is a material in which a problem may occur upon being heated by an induction heat cooking apparatus, a blocking signal may be output such that current does not flow in a working coil, thereby preventing the induction heat cooking apparatus from being damaged.

According to the embodiments of the present invention, upon determining that a cooking vessel is present, a switch corresponding to a burner on which the cooking vessel is located is activated, thereby increasing user convenience.

The description above is merely illustrative of the technical idea of the present invention, and various changes and modifications may be made by those skilled in the art without departing from the essential characteristics of the present invention.

Therefore, the embodiments disclosed in the present invention are intended to illustrate rather than limit the scope of the present invention, and the scope of the technical idea of the present invention is not limited by these embodiments.

The scope of protection of the present invention should be construed according to the following claims, and all technical ideas within the scope of equivalents should be construed as being included in the scope of the present invention.

What is claimed is:

1. An induction heat cooking apparatus comprising:

a power supply configured to supply an alternating current (AC) voltage;

a rectifier configured to convert the AC voltage into a direct current (DC) voltage;

a working coil configured to operate based on the DC voltage generated from the rectifier;

a first switch and a second switch that are configured to control supply of the DC voltage to the working coil and that are configured to alternately apply the DC voltage to the working coil;

a comparison circuit that is configured to sense current flowing in the working coil, that is configured to compare the sensed current to a reference value, and that is configured to generate output pulses based on a comparison result of the sensed current with respect to the reference value; and a controller configured to:

count a number of the output pulses generated from the comparison circuit, and determine whether a cooking vessel is present on the working coil based on the number of the output pulses.

2. The induction heat cooking apparatus according to claim 1, wherein the comparison circuit is further configured to:

generate output pulses having a high level voltage based on the sensed current being greater than the reference value; and generate output pulses having a low level voltage based on the sensed current being less than the reference value, the high level voltage being greater than the low level voltage.

3. The induction heat cooking apparatus according to claim 1, wherein the controller is further configured to:

count the number of the output pulses in a state in which one of the first switch or the second switch maintains an ON state to apply the DC voltage to the working coil; and determine whether the cooking vessel is present on the working coil based on the number of the output pulses determined in the state in which the one of the first switch or the second switch maintains the ON state.

4. The induction heat cooking apparatus according to claim 1, wherein the controller is further configured to:

determine that the cooking vessel is present on the working coil based on the number of the output pulses being less than or equal to a reference number; and determine that the cooking vessel is not present on the working coil based on the number of the output pulses exceeding the reference number.

5. The induction heat cooking apparatus according to claim 1, wherein the controller is further configured to, based on a determination that the cooking vessel is not present on the working coil, output a signal configured to restrict flow of current in the working coil.

6. The induction heat cooking apparatus according to claim 1, wherein the controller is further configured to:

determine whether the cooking vessel is present on the working coil based on an output pulse that is generated from the comparison circuit after the first switch and the second switch has alternately applied the DC voltage to the working coil a predetermined number of times or more.

7. The induction heat cooking apparatus according to claim 1, wherein the reference value includes an average of current flowing in the working coil that is determined based on the DC voltage applied to the working coil a plurality of times by the first and second switches, and wherein the comparison circuit is configured to compare a voltage corresponding to the current flowing in the working coil to a reference voltage corresponding to the reference value.

8. The induction heat cooking apparatus according to claim 1, wherein the first switch is configured to apply the DC voltage to the working coil based on the second switch not applying the DC voltage to the working coil, and wherein the second switch is configured to apply the DC voltage to the working coil based on the first switch not applying the DC voltage to the working coil.

9. The induction heat cooking apparatus according to claim 1, wherein the first switch is configured to restrict the DC voltage from being applied to the working coil based on the second switch applying the DC voltage to the working coil, and wherein the second switch is configured to restrict the DC voltage from being applied to the working coil based on the first switch not applying the DC voltage to the working coil.

10. An induction heat cooking apparatus comprising:

a power supply configured to supply an alternating current (AC) voltage;

a rectifier configured to convert the AC voltage into a direct current (DC) voltage;

a working coil configured to operate based on the DC voltage generated from the rectifier;

a first switch and a second switch that are configured to control supply of the DC voltage to the working coil and that are configured to alternately apply the DC voltage to the working coil;

a comparison circuit that is configured to sense current flowing in the working coil, that is configured to compare the sensed current to a reference value, and that is configured to generate output pulses based on a comparison result of the sensed current with respect to the reference value; and a controller configured to determine whether a cooking vessel is present on the working coil based on the output pulses generated from the comparison circuit, wherein the working coil is arranged between the comparison circuit and at least one of the first switch or the second switch.

11. A method for determining presence of a cooking vessel on a working coil of an induction heat cooking apparatus, the method comprising:

alternately applying a DC voltage to the working coil by a first switch and a second switch of the induction heat cooking apparatus;

sensing current flowing in the working coil based on the first switch and the second switch alternately applying the DC voltage to the working coil;

comparing the current to a reference value;

generating output pulses based on a comparison result of the sensed current with respect to the reference value;

counting a number of the output pulses; and determining whether the cooking vessel is present on the working coil based on the number of the output pulses.

12. The method of claim 11, wherein generating the output pulses comprises:

generating output pulses having a high level voltage based on the sensed current being greater than the reference value; and generating output pulses having a low level voltage based on the sensed current being less than the reference value, the high level voltage being greater than the low level voltage.

13. The method of claim 11, wherein counting the number of the output pulses comprises counting the number of the output pulses in a state in which one of the first switch or the second switch maintains an ON state to apply the DC voltage to the working coil.

* * * * *